US006811144B2

(12) United States Patent
Denman et al.

(10) Patent No.: US 6,811,144 B2
(45) Date of Patent: Nov. 2, 2004

(54) APPARATUS WITH COLLAPSIBLE MODULES FOR ABSORBING ENERGY FROM THE IMPACT OF A VEHICLE

(76) Inventors: Owen S. Denman, 180 River Rd., Rio Vista, CA (US) 94571; Gerrit Andrew Dyke, 180 River Rd., Rio Vista, CA (US) 94571; Jack S. Mazer, 180 River Rd., Rio Vista, CA (US) 94571

( * ) Notice: Subject to any disclaimer, the term of this patent is extended or adjusted under 35 U.S.C. 154(b) by 0 days.

(21) Appl. No.: 10/125,233

(22) Filed: Apr. 17, 2002

(65) Prior Publication Data

US 2003/0057410 A1 Mar. 27, 2003

Related U.S. Application Data

(60) Provisional application No. 60/324,312, filed on Sep. 24, 2001.

(51) Int. Cl.[7] ..... E01F 15/00

(52) U.S. Cl. ..... 256/13.1; 404/6

(58) Field of Search ..... 256/1, 13.1; 404/6; 188/371, 377

(56) References Cited

U.S. PATENT DOCUMENTS

| | | | | | |
|---|---|---|---|---|---|
| 3,528,530 | A | * | 9/1970 | Franck et al. | |
| 3,621,732 | A | * | 11/1971 | Kaniut | |
| 3,643,924 | A | | 2/1972 | Fitch | |
| 3,695,583 | A | | 10/1972 | Walker et al. | |
| 3,699,624 | A | * | 10/1972 | De Gain | |
| 3,768,781 | A | | 10/1973 | Walker et al. | |
| 4,009,622 | A | | 3/1977 | Hinderks | |
| 4,452,431 | A | | 6/1984 | Stephens et al. | |
| 4,583,716 | A | * | 4/1986 | Stephens et al. | 256/13.1 |
| 4,655,434 | A | * | 4/1987 | Bronstad | 256/13.1 |
| 4,674,911 | A | | 6/1987 | Gertz | |
| 4,815,565 | A | | 3/1989 | Sicking et al. | |
| 4,838,523 | A | * | 6/1989 | Humble et al. | 256/13.1 |
| 4,844,213 | A | | 7/1989 | Travis | |
| 5,020,175 | A | | 6/1991 | Kirkpatrick et al. | |
| 5,022,782 | A | * | 6/1991 | Gertz et al. | 256/13.1 X |
| 5,112,028 | A | * | 5/1992 | Laturner | 256/13.1 |
| 5,391,016 | A | | 2/1995 | Ivey et al. | |
| 5,660,496 | A | | 8/1997 | Muller et al. | |
| 5,746,419 | A | | 5/1998 | McFadden et al. | |
| 5,797,591 | A | * | 8/1998 | Krage | 256/13.1 |
| 5,851,005 | A | | 12/1998 | Muller et al. | |
| 6,085,878 | A | | 7/2000 | Araki et al. | |
| 6,116,805 | A | | 9/2000 | Gertz | |
| 6,129,342 | A | * | 10/2000 | Bronstad | 256/13.1 |
| 6,203,079 | B1 | | 3/2001 | Breed | |
| 6,536,986 | B1 | * | 3/2003 | Anghileri et al. | 404/6 |

* cited by examiner

*Primary Examiner*—Daniel P. Stodola
*Assistant Examiner*—Ryan M. Flandro
(74) *Attorney, Agent, or Firm*—Thomas R. Lampe

(57) ABSTRACT

Apparatus for absorbing energy when impacted by a vehicle includes relatively movable vertical, spaced supports supporting modules extending between the supports. At least one of the modules has elongated openings formed therein which define deformable module side wall strips located between the module ends. These module side wall strips bend in response to application of opposed forces to the module ends.

9 Claims, 6 Drawing Sheets

APPARATUS WITH COLLAPSIBLE MODULES FOR ABSORBING ENERGY FROM THE IMPACT OF A VEHICLE

This application is based on and claims the benefit of U.S. Provisional Patent Application No. 60/324,312, filed Sep. 24, 2001.

TECHNICAL FIELD

This invention relates to apparatus for absorbing energy when impacted by a vehicle. More specifically, the apparatus is utilized as a barrier which dissipates the energy of moving vehicles upon impact to reduce injury to the vehicle's occupants and damage to structure protected by the barrier apparatus.

BACKGROUND OF THE INVENTION

It is well known to provide impact absorbing systems, often called "crash cushions" adjacent to rigid structures such as pillars, bridge abutments, lighting poles and the like for the purpose of absorbing vehicle impact energy and minimizing the effects of impact on the vehicle, the vehicle's occupants and the structure being protected.

There are many forms and types of energy absorption barriers.

U.S. Pat. No. 5,851,005, issued Dec. 22, 1998, discloses an energy absorption apparatus in the form of a modular energy absorption barrier assembly including multiple pairs of ground engaging support uprights interconnected to one another by overlapping side panels. The side panels and uprights are connected together by inter-engaging slides so that an impact at the end of the barrier assembly can cause relative movement between the uprights, between the side panels, and between the uprights and the side panels.

Located between the uprights and secured thereto are a plurality of energy absorbing metal plates configured in such a way that they collapse in a controlled manner upon vehicle impact to absorb impact forces.

U.S. Pat. No. 4,009,622, issued Mar. 1, 1977, discloses a structural member suitable for incorporation in motor vehicles especially as a steering column which incorporates metal truncated cones disposed end to end which incorporate nicks or cuts which can grow to full-scale tears during collapse as the structural member is subjected to an endwise load. All or part of the interior of the column when mounted in a vehicle may be used as a reservoir to contain fire fighting fluid, fluid under pressure which is part of the vehicle's hydraulic system, hot or cold fluid which is part of an engine cooling or air conditioning system or fluid which is part of a vehicle's lubrication or fuel system.

The following patents are also known and are believed to be further representative of the current state of the crash cushion art: U.S. Pat. No. 6,203,079, issued Mar. 20, 2001, U.S. Pat. No. 3,643,924, issued Feb. 22, 1972, U.S. Pat. No. 3,695,583, issued Oct. 3, 1972, U.S. Pat. No. 3,768,781, issued Oct. 30, 1973, U.S. Pat. No. 5,020,175, issued Jun. 4, 1991, U.S. Pat. No. 5,391,016, issued Feb. 21, 1995, U.S. Pat. No. 5,746,419, issued May 5, 1998, U.S. Pat. No. 6,085,878, issued Jul. 11, 2000, U.S. Pat. No. 4,815,565, issued Mar. 28, 1989, U.S. Pat. No. 6,116,805, issued Sep. 12, 2000, U.S. Pat. No. 4,844,213, issued Jul. 4, 1989, U.S. Pat. No. 4,452,431, issued Jun. 5, 1984, U.S. Pat. No. 4,674,911, issued Jun. 23, 1987, U.S. Pat. No. 5,851,005, issued Dec. 22, 1998, U.S. Pat. No. 5,660,496, filed Aug. 26, 1997, and U.S. Pat. No. 4,009,622, issued Mar. 1, 1977.

DISCLOSURE OF INVENTION

The present invention relates to apparatus for absorbing energy when impacted by a vehicle. The apparatus incorporates energy absorbing modules of a specified structure and configuration which provide for the controlled absorption of impact forces. The energy absorbing modules are relatively inexpensive and may quickly and readily be installed or removed relative to the rest of the apparatus.

The apparatus includes a plurality of vertical, spaced supports.

An energy absorbing module is disposed between and supported by adjacent supports of the plurality of vertical, spaced supports.

The energy absorbing module has a module side wall and spaced module ends defining a module interior. The module side wall has a plurality of elongated openings formed therein defining deformable module side wall strips located between the module ends and extending longitudinally along the energy absorbing module.

The module side wall strips bend responsive to application of opposed forces on the module ends due to relative movement between the adjacent supports caused by a vehicle impacting the apparatus.

Other features, advantages and objects of the present invention will become apparent with reference to the following description and accompanying drawings.

MODES FOR CARRYING OUT THE INVENTION

Figure 1:
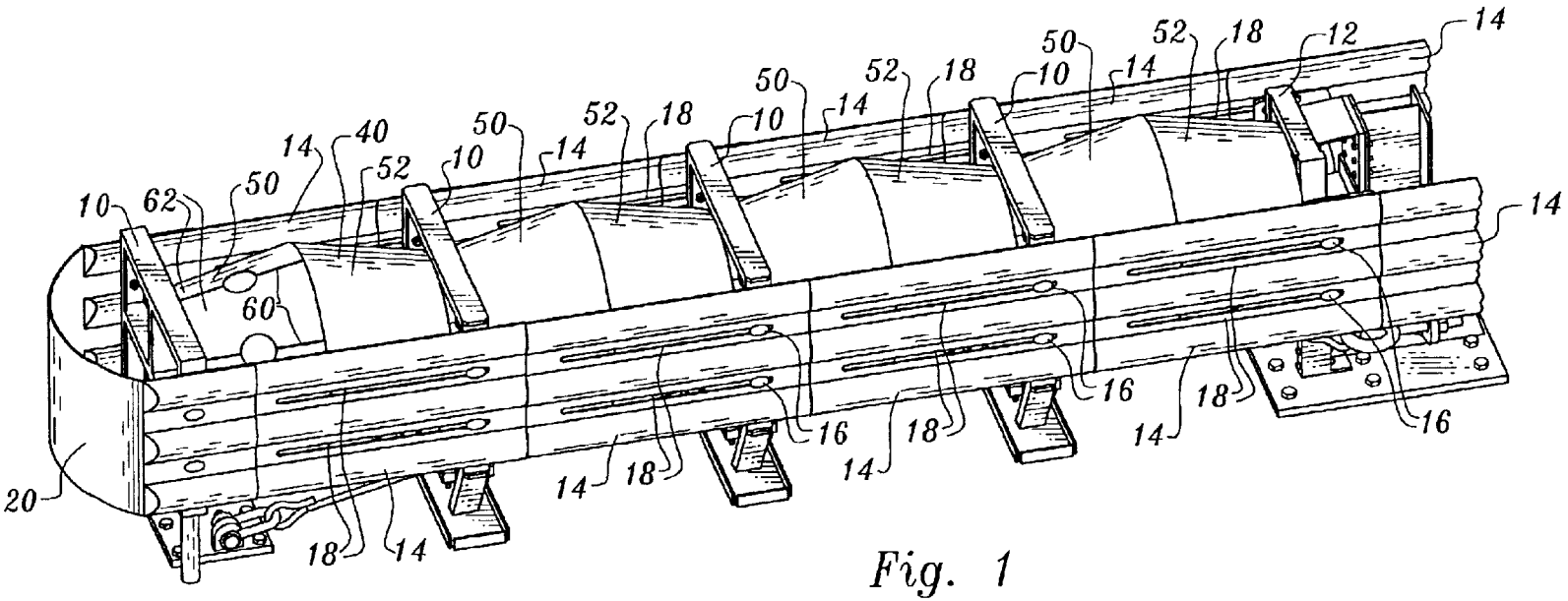
FIG. 1 is a perspective view of apparatus constructed in accordance with the teachings of the present invention and employing a plurality of energy absorbing modules supported by and extending between vertical, spaced supports.
Figure 2:
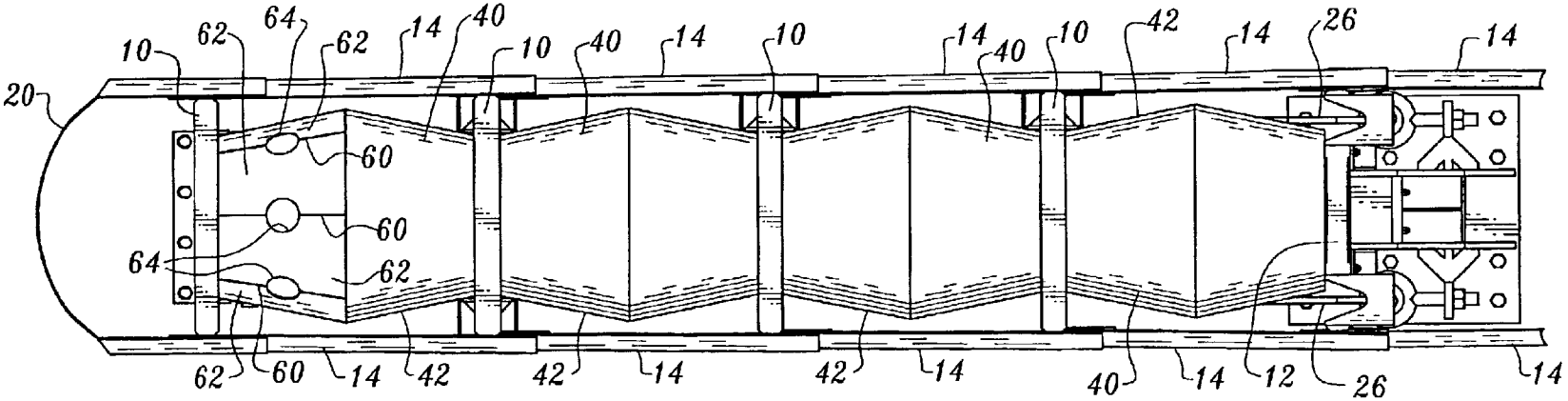
FIG. 2 is a plan view of the apparatus.
Figure 3:
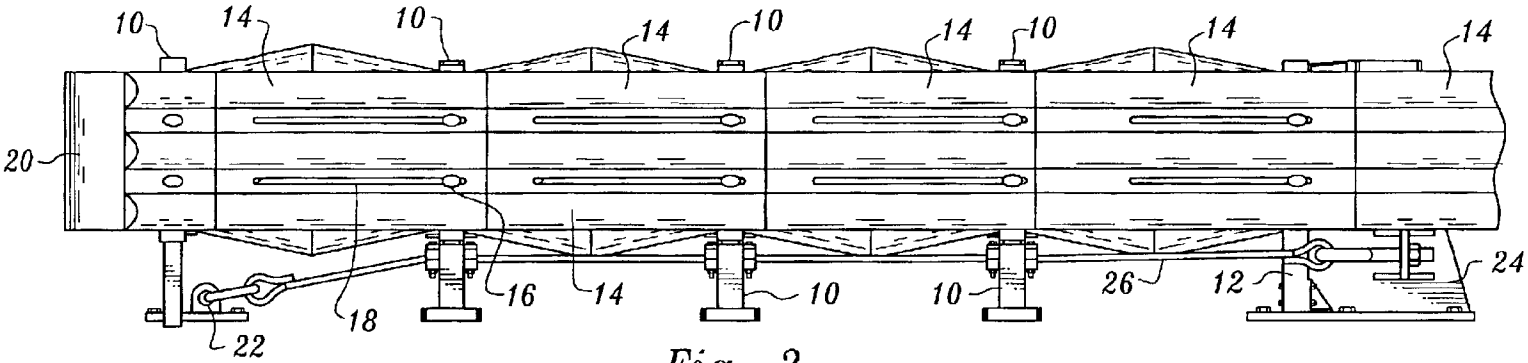
FIG. 3 is a side elevational view of the apparatus.

Referring now to FIGS. 1–3, 6–11 and 13–20, apparatus constructed in accordance with the teachings of the present invention is illustrated. The apparatus includes a plurality of vertical, spaced supports in the form of steel support frames 10 and a substantially immovable steel support frame 12, the latter fixedly anchored in a rearmost position relative to the other of the vertical, spaced supports. The supports extend upwardly from the ground.

The supports or uprights 10, 12 are interconnected to one another by overlapping side panels 14 which may, for example, be corrugated guard rails well known to those skilled in the art. The side panels 14 and the supports 10, 12 are connected together by slides 16 projecting from supports and positioned in slots 18 extending longitudinally and formed in side panels 14.

A front impact member or nose 20 is located at the forward end of the apparatus, the nose overlapping to a certain extent the pair of frontmost side panels 14.

The apparatus includes front anchor structure 22 and rear anchor structure 24, the anchor structures being fixed in position and essentially immovable. For example, the anchor structures may be bolted to blocks of concrete embedded in the ground, as shown for example in FIGS. 6 and 7.

Extending between the front and rear anchor structures are two parallel cables 26.

The apparatus includes cable guide structures incorporating guide members 28 which are placed around the cables and then connected by bolts to the supports 10. Cable passageways 30 defined by the guide members are sized to allow relative slidable movement between the cables and the guide members 28 upon application of suitable forces to such structural arrangement.

The just described arrangement provides some degree of stiffness to the supports 10, keeping them from rotating about their vertical axes when moving rearward responsive to a frontal impact on the system. This is desirable since when the diaphragm skews too much, it causes the side panels and slides 16 to encounter interference which could cause the apparatus to "lock up" and not compress efficiently. This also causes the energy absorbing modules (which will be described below) to not compress evenly or efficiently.

Located between the cables 26 and disposed between and supported by supports 10, 12 are energy absorbing modules 40. Each energy absorbing module or unit has a module side wall 42 and spaced module ends 44, 46. The modules 40 include two module segments 50, 52. The side wall 42 of the module 40 forms a truncated cone at each of the module segments, extending away from an end of the module and diverging outwardly in the direction of the other module segment.

The modules 40 are collapsible containers, the module segments defining a pressurizable interior. In the illustrated embodiment, a blow-out plug 54 is located in an aperture or opening formed in each of the end walls, the blow-out plugs breaking away from the module segments when sufficient pressure builds up inside the energy absorbing module. However, in accordance with the teachings of the present invention, it is not necessary that blow-out plugs or openings be formed in the energy absorbing modules, unless desired. In the arrangement illustrated, (see FIG. 10) smaller apertures 60 not covered by blow-out plugs are located adjacent to the blow-out plug to allow for the egress of air from the module interior at a controlled rate.

Each energy absorbing module 40 is of integral construction, preferably being formed of roto-molded plastic, for example, cross linked polyethylene.

It will be seen that the modules 40 are disposed in alignment when installed between the supports 10, the planar end walls 44, 46 thereof being vertically oriented, parallel and positioned in engagement with, or at least in close proximity to, the supports with which the modules are associated.

The interiors of the energy absorbing modules 40 may suitably be filled with a foam, such as a polyurethane foam formed in situ. All, some, or none of the energy absorbing modules may be foam filled to provide the desired characteristics during collapse.

In the forward most module 40 of the embodiment under discussion, the module side wall at module segment 50 has a plurality of elongated narrow openings or slots 60 formed therein defining deformable module side wall strips 62 which bend responsive to application of opposed forces on the module ends of the forward most module due to relative movement between the supports holding the module such as might be caused by a vehicle impacting the apparatus. Holes 64 are defined by the module side wall at module segment 50 communicating with the module interior and also communicating with the elongated openings 60. The holes are illustrated as being located substantially mid point along the length of slots 60.

Figure 12:
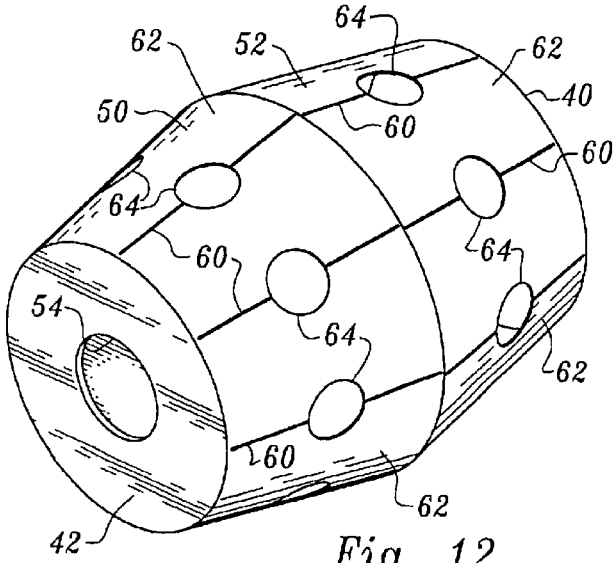
FIG. 12 is a perspective view of an alternative form of energy absorbing module.
Figure 11:
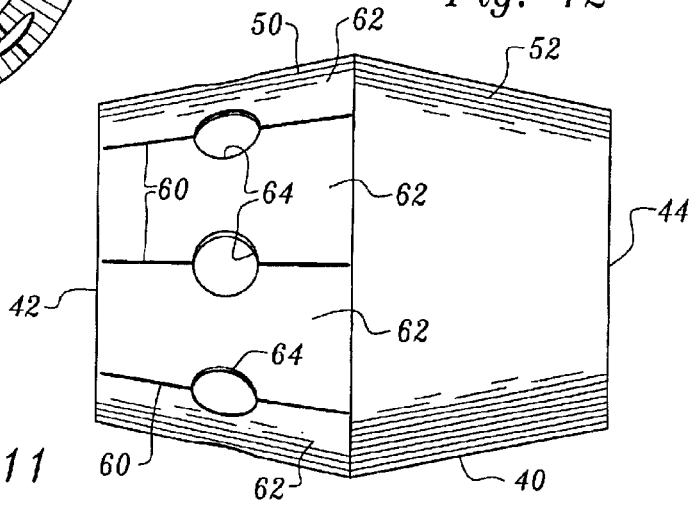
FIG. 11 is a side elevational view of the module of FIG. 8.
Figure 13:
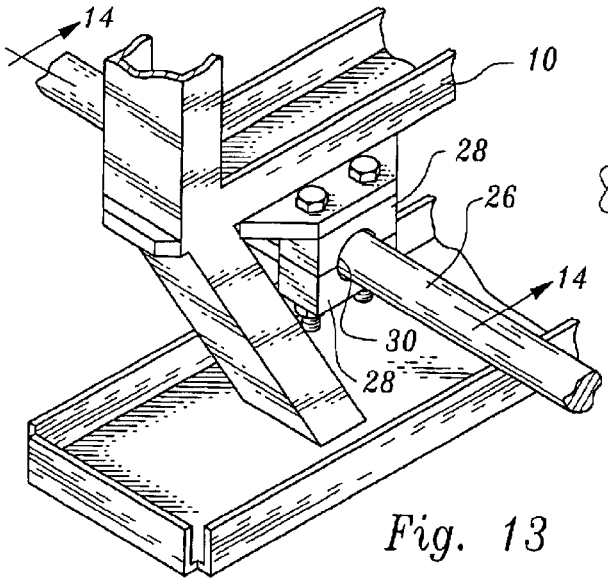
FIG. 13 is an enlarged, perspective view illustrating a portion of a vertical support having a cable guide structure affixed thereto surrounding and engaging a cable employed in the apparatus.
Figure 14:
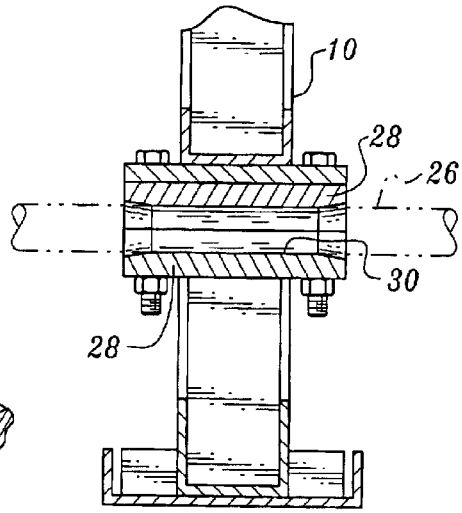
FIG. 14 is a cross-sectional view taken along the line 14—14 in FIG. 13.
Figure 15:
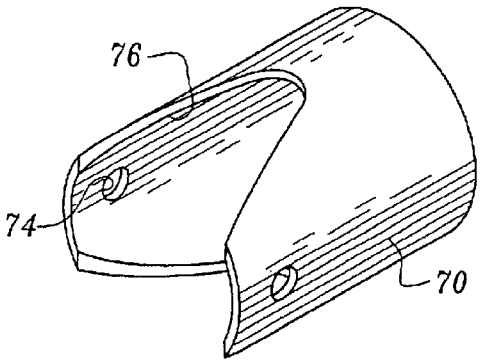
FIG. 15 is a perspective view of a spacer employed in the apparatus.
Figure 16:
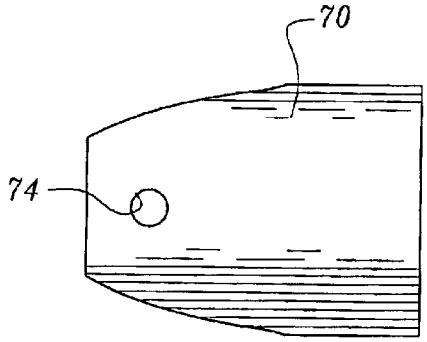
FIG. 16 is a side elevational view of the spacer.
Figure 17:
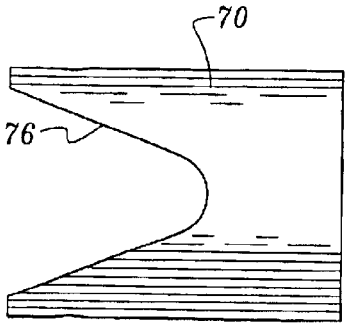
FIG. 17 is a top plan view of the spacer.

Elongated openings 60 and holes 64, if desired, may be located in both of the module segments 50, 52. Such an arrangement is illustrated in FIG. 12.

The function of the narrow, elongated openings or slots is to create the strips 62 which fold outwardly when the ends 44, 46 of the module are moved toward one another. The holes create necked-down or reduced areas in the strips, which encourages creation of folds at that location.

The strips 62 folding outwardly will occur at a much lower load than the folding of the sides of modules not incorporating the strips or holes; however, the actual load of the combination of all the strips folding can be varied by increasing or decreasing the thickness of the material being folded, the number of narrow, elongated openings, the size of the holes employed in combination with the slots, as well as other physical factors such as the slope of the outer module side wall.

With slots and folds formed in both segments of the module, there is not much likelihood of building up significant air pressure. However, if only one of the truncated segments has slots and if the module is compressed against a flat platen, once the center part of the module makes contact with the platen, air pressure can again build up; the point being that air pressure may or may not be an issue depending upon how the invention is implemented. It is possible that the modules could be reusable if molded from a plastic material having a significant position memory, i.e., ultra-high molecular weight polyethylene or some types of cross-linked polyethylene.

In the embodiment under discussion, only the forward module 40 has elongated narrow openings or holes in communication therewith. The remaining three modules 40 are free of such features and will provide greater resistence to compression.

Figure 7:
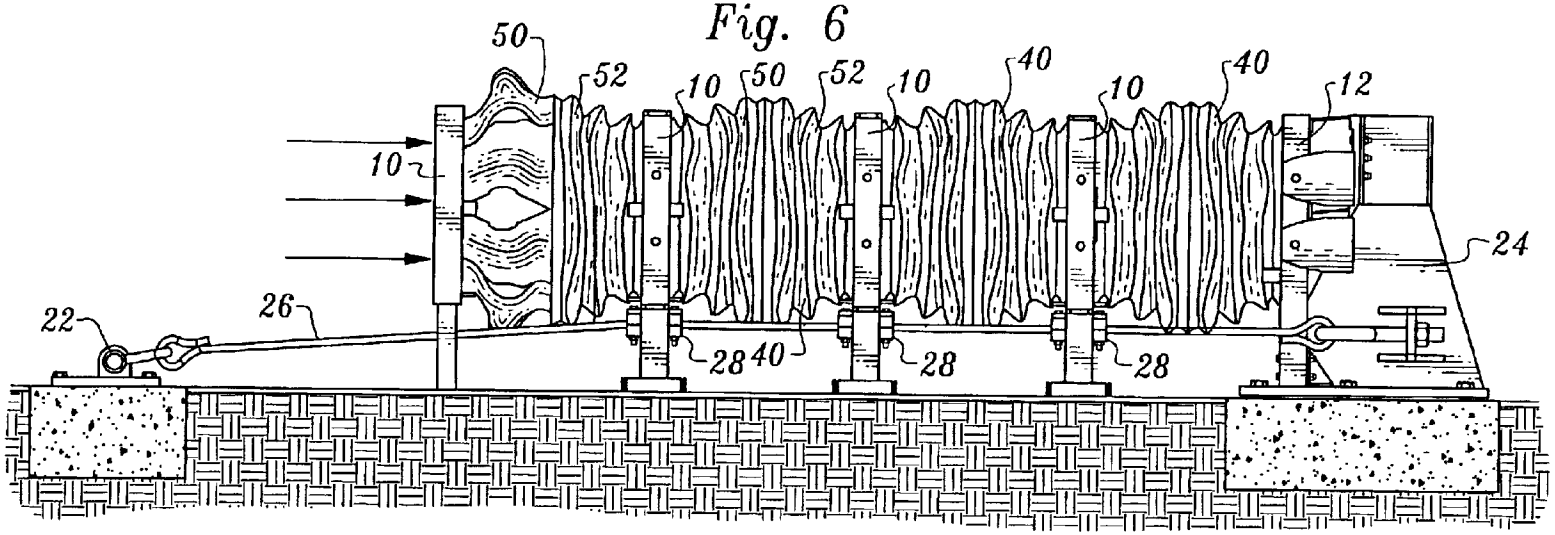
FIG. 7 is a view similar to FIG. 6, but illustrating the condition of the components after vehicle impact.
Figure 8:
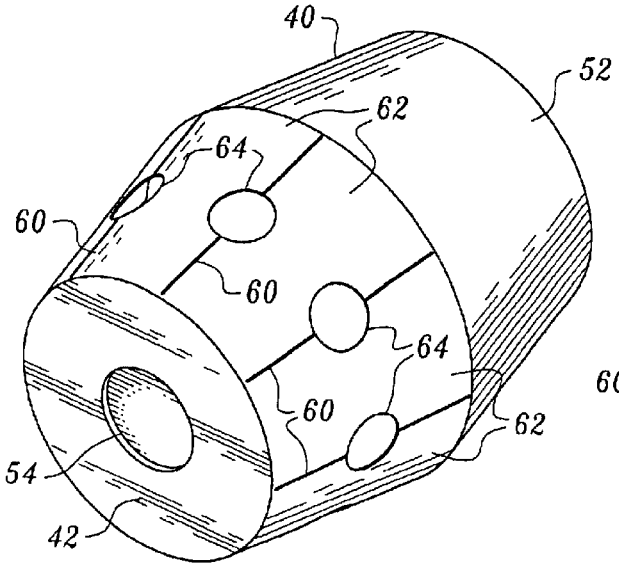
FIG. 8 is a perspective view of an energy absorbing module of the type employed in the above-described embodiments of the apparatus.
Figure 10:
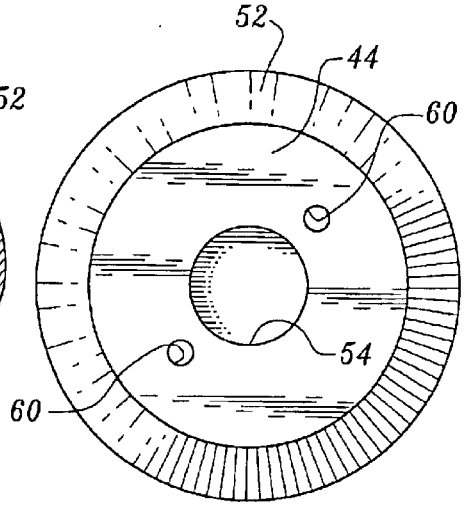
FIG. 10 is an elevational view of the end of the module of FIG. 8 opposed to the end shown in FIG. 9.
Figure 9:
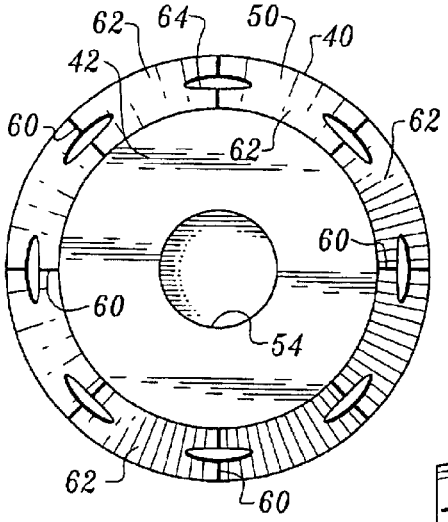
FIG. 9 is an end, elevational view of the module of FIG. 8.

FIG. 7 illustrates by arrows the application of an endwise force on the front support 10, as for example caused by vehicle impact. The first module to collapse will be the forward most module and this can occur with relatively little resistance due to the use of the elongated openings and holes. The modules 40 disposed behind the front or forward most module will collapse in a generally accordion fashion, providing significantly greater resistance to the impact.

Figure 4:
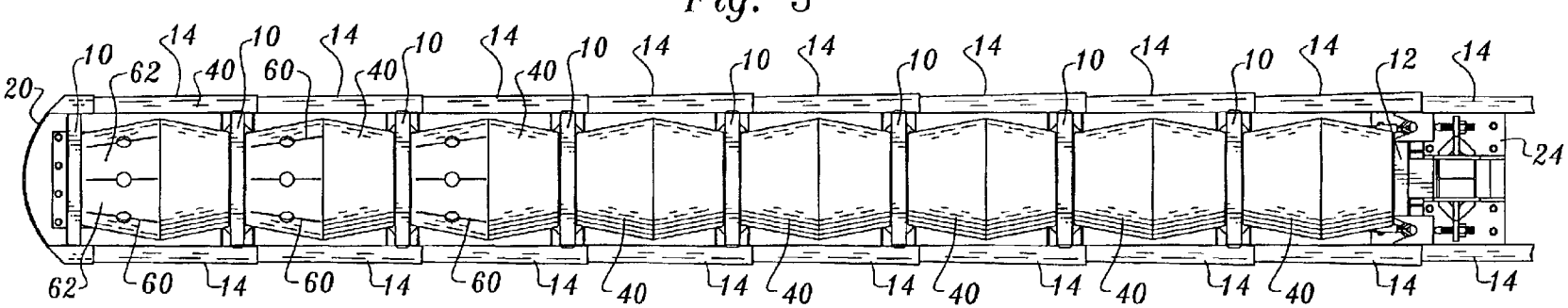
FIG. 4 is a plan view of an alternative form of apparatus.
Figure 5:
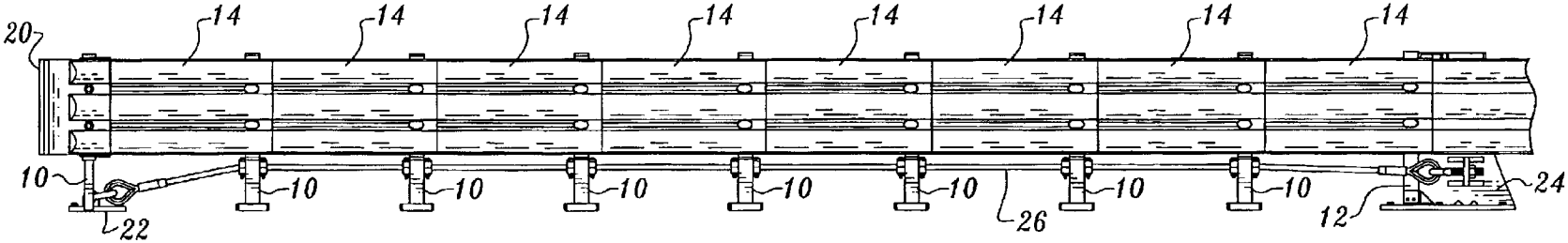
FIG. 5 is a side, elevational view of the embodiment of FIG. 4.
Figure 6:
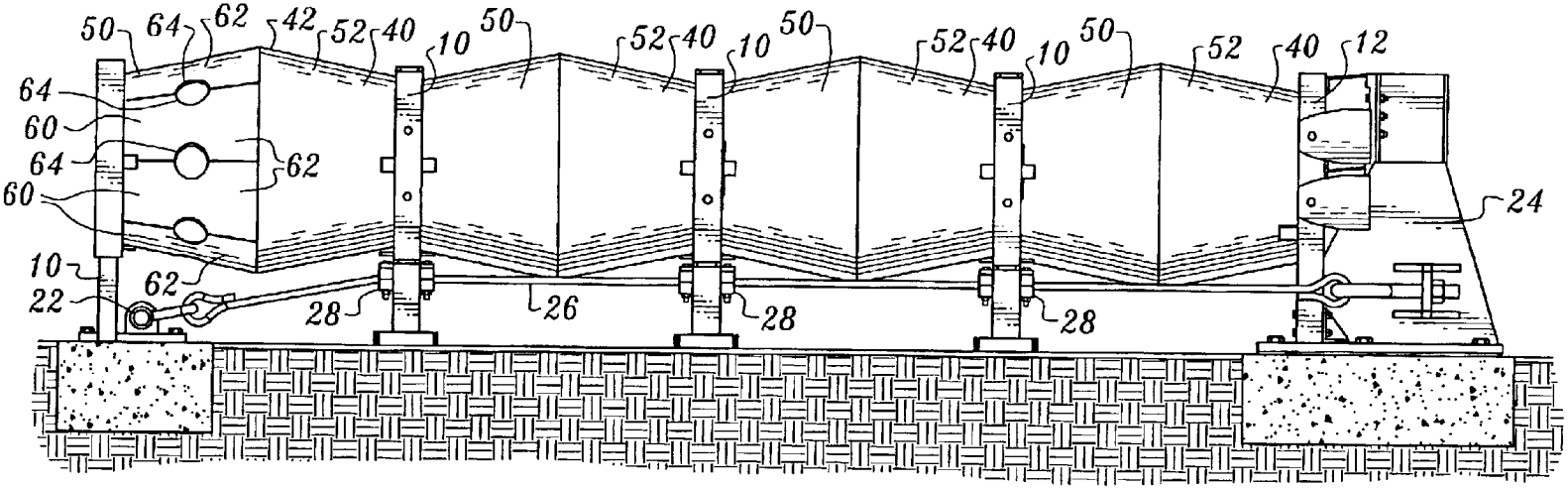
FIG. 6 is a view of the FIG. 1 embodiment similar to FIG. 3, but with side panels removed, the illustrated components being in the condition assumed thereby prior to vehicle impact.

The number of modules and the module mix may be changed in accordance with conditions. FIGS. 4 and 5 illustrate an embodiment of the invention wherein a total of eight modules 40 are employed, the front three of which incorporate elongated narrow openings 60 and holes 64 defining bendable strips.

Referring now especially to FIGS. 15–20, two pairs (upper and lower) of spacers 70 are affixed to opposed sides of rearmost support 12, such support in turn being affixed to rear anchor structure 24 so that support 12 is immobile or fixed in position. Bolts may be employed for such purpose, as shown. In addition, bolts 72 are employed to fixedly secure the spacers 70 to the rearmost side panels 14, the bolts passing through holes in the spacers as well as in the rearmost side panels.

The spacers 70 comprise cylindrically-shaped members which define hollow interiors and have forwardly directed open ends communicating with the hollow interiors. The spacers further define generally V-shaped notches 76 which extend rearwardly from the forwardmost open ends of the spacers. The notches communicate with the hollow interiors of the spacers.

Figure 18:
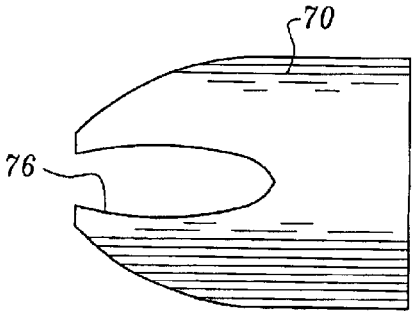
FIG. 18 is a view similar to FIG. 17, but illustrating the condition of the spacer after it has been bent by forces caused by the impact of a vehicle.
Figure 19:
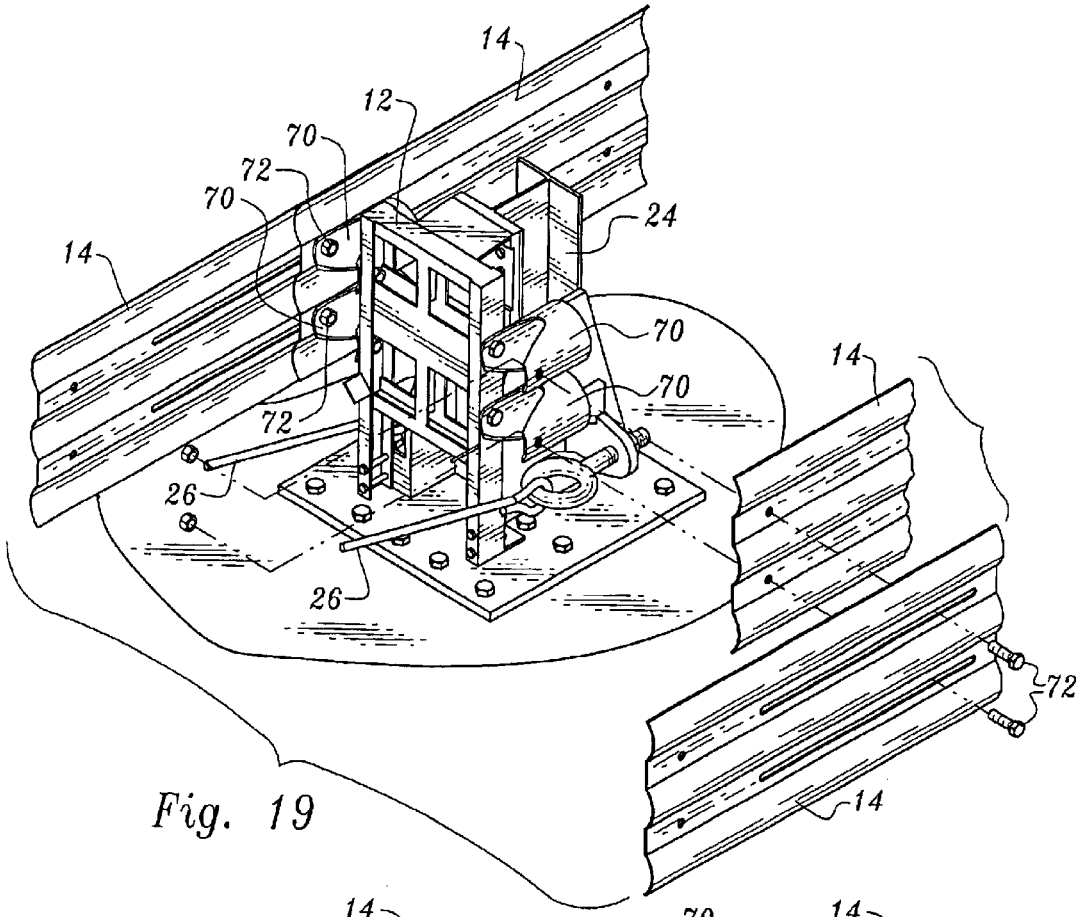
FIG. 19 is an exploded view illustrating details of selected components of the apparatus including side panels, rear anchor structure, cables connected to the rear anchor structure, an immovable support fixedly anchored in position and spacers.
Figure 20:
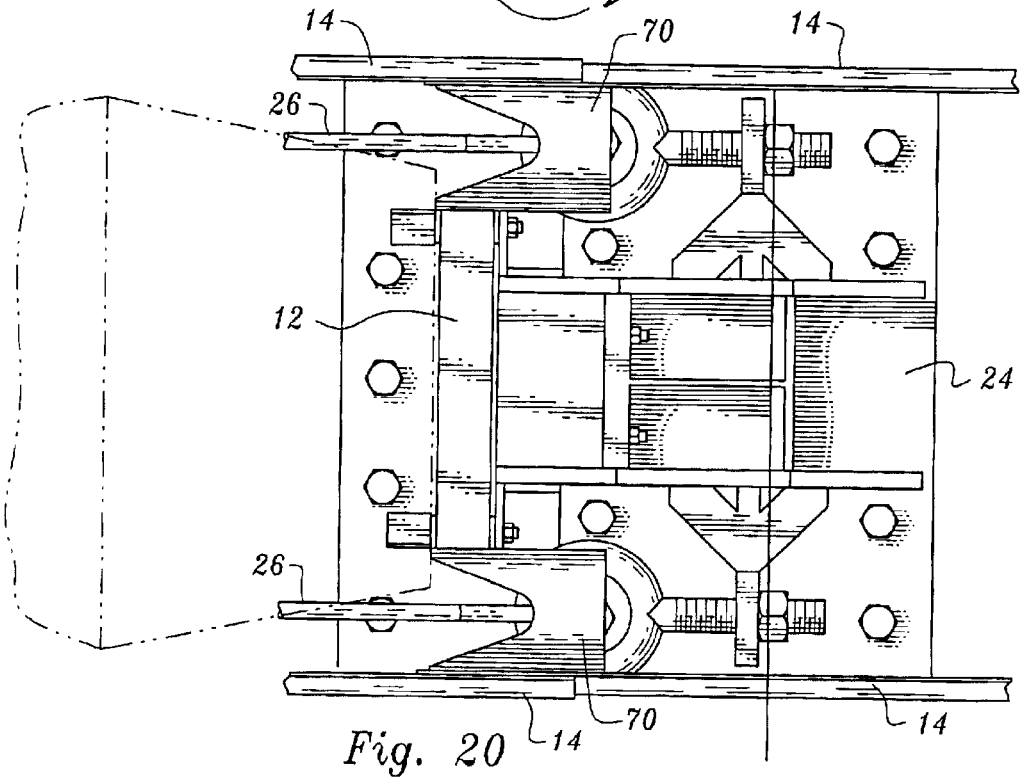
FIG. 20 is an enlarged, top plan view illustrating details of the structure shown in FIG. 19.

The purpose of the arrangement just described is to ensure that the spacers collapse at the ends thereof with the V-shaped notches upon very high loading of the side panels 14 attached to the spacers during redirective impacts in the region of this connection. Thus, the partially collapsed cylinder creates a ramp that is easier for the impacting vehicle to move past as it is being redirected than is the case with a non-sloped structural element that would have a tendency to snag the impacting vehicle. FIG. 18 shows a typical configuration of a spacer 70 after redirective impact, the notch changing in size, becoming substantially smaller to create a bent spacer end. The spacer 70 may suitably be formed of steel.

What is claimed is:

1. Apparatus attached to the ground for absorbing energy when impacted by a vehicle, said apparatus comprising, in combination:

a plurality of vertical, spaced supports aligned in a substantially horizontal direction; and a plurality of spaced energy absorbing modules including a forwardmost module, the energy absorbing modules of said plurality of energy absorbing modules disposed between and supported by different pairs of adjacent supports of said plurality of vertical, spaced supports, said plurality of energy absorbing modules being aligned in said substantially horizontal direction, said energy absorbing modules each having a module side wall and a pair of spaced module end walls defining a module interior, each energy absorbing module of said plurality of energy absorbing modules including two module segments, each of said module segments being the form of a truncated cone extending away from one of the module end walls diverging outwardly in the direction of the other module segment and attached thereto, the module side wall of said forwardmost module having a plurality of elongated openings formed therein defining deformable module side wall strips in an undeformed condition located between the module end walls thereof and extending longitudinally along said forwardmost module, said module side wall strips being formed of plastic sheet material having a position memory and bendable from said undeformed condition responsive to application of opposed forces on the module end walls of said forwardmost module due to relative movement between said adjacent supports supporting the forwardmost module caused by a vehicle impacting said apparatus, said module side wall of said forwardmost module defining holes communicating with the module interior thereof and with a plurality of the elongated openings formed in the module side wall thereof, said holes located between ends of said plurality of elongated openings, the forwardmost module being free of structure restraining outward movement of the module side wall strips thereof during bending thereof due to relative movement between said adjacent supports supporting the forwardmost module caused by a vehicle impacting the apparatus, and the position memory of the plastic sheet material of which the module side wall strips of said forwardmost module are constructed causing the module side wall strips of said forwardmost module after bending thereof due to vehicular impact to at least partly return to their undeformed.

2. The apparatus according to claim 1 wherein said forwardmost module is wholly formed from plastic, said module segments thereof being disposed in alignment and integrally attached.

3. The apparatus according to claim 2 wherein said forwardmost module is of molded plastic construction.

4. The apparatus according to claim 1 wherein said forwardmost module defines at least one aperture at a module end wall thereof allowing for the egress of air from the module interior thereof upon compression of said forwardmost; module and pressurization of the module interior thereof.

5. The apparatus according to claim 1 additionally comprising front anchor structure and rear anchor structure spaced from said front anchor structure, said plurality of energy absorbing modules and said plurality of vertical, spaced supports being positioned in front of said rear anchor structure, cable guide structures fixedly attached to said vertical, spaced supports and a pair of parallel and substantially horizontally disposed tension cables affixed to said front anchor structure and said rear anchor structure and extending therebetween, said cables supported by said cable guide structures and slidably disposed in said cable guide structures for allowing movement of said vertical, spaced supports toward one another while resisting lateral movement thereof.

6. Apparatus for absorbing energy when impacted by a vehicle, said apparatus comprising, in combination:

a plurality of vertical, spaced supports;

a plurality of energy absorbing modules supported by adjacent supports of said plurality of vertical, spaced supports, at least some of said energy absorbing modules being disposed in alignment, each of said energy absorbing modules having a module side wall and spaced module ends defining a module interior, the module side wall of at least one of said energy absorbing modules having a plurality of elongated openings formed therein defining deformable module side wall strips located between said module ends of said at least one energy absorbing module and extending longitudinally along said at least one energy absorbing module, said module side wall strips bendable responsive to application of opposed forces on said module ends due to relative movement between said adjacent supports caused by a vehicle impacting said apparatus, said plurality of vertical, spaced supports including a substantially immovable support fixedly anchored in a rearmost position relative to the other of said vertical, spaced supports;

a pair of spacers, said spacers of said pair of spacers being affixed to opposed sides of said substantially immovable support; and a plurality of partially overlapping side panels connected to opposed sides of said plurality of vertical, spaced supports, one opposed pair of said side panels being fixedly attached to said pair of spacers, said spacers defining hollow interiors and having open distal ends communicating with said hollow interiors, said spacers further defining notches extending inwardly from said distal ends and communicating with said hollow interiors, said notches facilitating partial collapse of said spacer when loading forces resulting from redirective vehicle impacts are applied to the spacers by the side panels fixedly attached thereto.

7. The apparatus according to claim 6 wherein said spacers comprise cylindrical-shaped members and wherein said notches are generally V-shaped.

8. Apparatus for absorbing energy when impacted by a vehicle, said apparatus comprising, in combination:

a plurality of vertical, spaced supports;

a plurality of energy absorbing modules disposed in substantial horizontal alignment between and supported by said plurality of vertical, spaced supports, each said energy absorbing module having a module side wall and spaced module ends defining a module interior, said module side walls deformable responsive to application of opposed forces on said module ends due to relative movement between at least some of said vertical spaced supports caused by a vehicle impacting said apparatus, said plurality of vertical, spaced supports including a substantially immovable support fixedly anchored in a rearmost position relative to the other of said vertical, spaced supports;

at least one pair of spacers, said spacers of said at least one pair of spacers being affixed to opposed sides of said substantially immovable supports; and a plurality of partially overlapping side panels connected, to opposed sides of said plurality of vertical, spaced supports, one opposed pair of said side panels being fixedly attached to said pair of spacers, said spacers defining hollow interiors and having open ends communicating with said hollow interiors, said spacers further defining notches extending inwardly from said open ends and communicating with said hollow interiors, said notches facilitating partial collapse of said spacers when loading forces resulting from redirective vehicle impacts are applied to the spacers by the side panels fixedly attached thereto.

9. The apparatus according to claim 8 wherein said spacers comprise cylindrical-shaped members and wherein said notches are generally V-shaped.

* * * * *